US007225744B2

(12) United States Patent
Gladnick et al.

(10) Patent No.: US 7,225,744 B2
(45) Date of Patent: Jun. 5, 2007

(54) CHAIR LIFT ACCESSORY FOR ACCOMMODATING SNOWBOARDERS AND MOUNTAIN BIKERS

(76) Inventors: Jeffrey Christopher Gladnick, 51 Bridle Brook La., Newark, DE (US) 19711; Peter Jonathan Boyle, 12 James St., Newton, NJ (US) 07860; Matthew Nickolas Eberhardt, 57 Stephenville Blvd., Red Bank, NJ (US) 07701

( * ) Notice: Subject to any disclaimer, the term of this patent is extended or adjusted under 35 U.S.C. 154(b) by 0 days.

(21) Appl. No.: 10/340,036

(22) Filed: Jan. 9, 2003

(65) Prior Publication Data

US 2004/0000529 A1 Jan. 1, 2004

Related U.S. Application Data

(60) Provisional application No. 60/346,935, filed on Jan. 9, 2002.

(51) Int. Cl.
*B61B 7/00* (2006.01)

(52) U.S. Cl. ..... 105/149.1; 297/423.4; 248/230.1

(58) Field of Classification Search ..... 104/73.2, 104/112, 173.1, 173.2; 280/809; 297/423.4; 248/230.1, 230.6, 228.1, 228.5, 228.6, 230.5, 248/231.85, 219.4; 105/149.1, 149.2
See application file for complete search history.

(56) References Cited

U.S. PATENT DOCUMENTS 3,612,460 A * 10/1971 Smith ..... 40/607.12
3,747,974 A * 7/1973 Tauzin ..... 297/184.12
4,013,318 A 3/1977 Piper ..... 297/423.4
4,103,853 A * 8/1978 Bannan ..... 248/219.1
4,556,252 A * 12/1985 Serex ..... 297/423.4
4,706,400 A * 11/1987 Howard et al. ..... 40/617
5,094,479 A * 3/1992 Shields ..... 280/814
5,213,048 A * 5/1993 Kunczynski ..... 105/149.2
5,335,889 A * 8/1994 Hopkins et al. ..... 248/231.81
5,337,986 A * 8/1994 Vollink ..... 248/218.4
5,428,913 A * 7/1995 Hillstrom ..... 40/604
5,508,895 A * 4/1996 Wagoner, Jr. ..... 362/477
5,586,503 A * 12/1996 Rehorn ..... 104/241
6,217,071 B1 * 4/2001 Shia ..... 280/809
6,279,286 B1 * 8/2001 Ichihashi ..... 52/489.1
6,290,260 B1 9/2001 Brill ..... 280/809
6,450,511 B1 9/2002 LaVoy ..... 280/14.22
6,453,824 B1 * 9/2002 Dobbins ..... 105/149.1
6,520,573 B2 * 2/2003 Osterle ..... 297/184.11
6,618,973 B2 * 9/2003 Nelson ..... 40/604
6,691,624 B2 * 2/2004 Albrich ..... 105/149.2

* cited by examiner

*Primary Examiner*—Carl D. Friedman
*Assistant Examiner*—Steven Marsh
(74) *Attorney, Agent, or Firm*—Volpe and Koenig, P.C.

(57) ABSTRACT

A support for chairlifts includes bracketing for easily and simply retrofitting the support to an existing chairlift for providing support for snowboards on a chairlift which is easy to mount and provides a rugged, secure support. By changing orientation of the support on this chairlift, it may be utilized to support a mountain bike or skateboard.

4 Claims, 10 Drawing Sheets

CHAIR LIFT ACCESSORY FOR ACCOMMODATING SNOWBOARDERS AND MOUNTAIN BIKERS

CROSS REFERENCE TO RELATED APPLICATION(S)

This application claims priority from U.S. provisional patent application No. 60/346,935 filed on Jan. 9, 2002 which is incorporated by reference as if fully set forth.

FIELD OF THE INVENTION

The present invention relates to ski lifts and more particularly to an accessory for enabling ski lifts to accommodate mountain bikers and snowboarders as well as skiers.

BACKGROUND

The present invention relates to ski chairlifts. More particularly, the invention relates to a novel support which may be simply and rapidly mounted to existing chairlifts providing a rugged, reliable support for snowboards and/or mountain bikes.

Ski resorts have long provided chairlifts for skiers. Recently, however there has been an upsurge in the number of snowboarders to the extent that ski resorts, which originally did not permit snowboarders at ski resorts, now welcome snowboarders. Although snowboarders are now welcome at ski resorts, conventional chairlifts presently in use are not "user friendly" to snowboarders. Skiers and snowboarders typically ride chairlifts wearing their respective skis and snowboards. Skis are worn in such a manner that the skis face in the same direction as the feet of the user. However, a snowboard extends in a direction substantially perpendicular to the direction in which the users feet point.

Conventional chairlifts, while providing a support for resting skis, lack a support for snowboards. As a result, a snowboarder is inconvenienced when riding a chairlift due to this lack of support.

SUMMARY

It is therefore an object of the present invention to provide a support for snowboards and the like which is capable of being readily and easily mounted to a chairlift, and specifically to a chairlift having a ski support, in a simple and quick manner while providing a rugged, reliable support for snowboards and which is capable of providing reliable operation over significant periods of rough use.

The present invention is characterized by comprising a main member which cooperates with mounting brackets designed to be readily and easily mounted to a chairlift and specifically to a support arm for ski supports thereby providing a chairlift capable of accommodating both skiers and snowboarders wherein, when a chairlift which accommodates both skiers and snowboarders, the chairlift is capable of accommodating any combination thereof, i.e., two skiers, two snowboarders, or a skier and a snowboarder and is further capable of enabling the skier and snowboarder to occupy either seat in a two-seat chairlift.

One of the preferred embodiments is further designed to accommodate a mountain bike through a simple, easy mounting arrangement which utilizes the same mounting members employed to accommodate snowboarders, thereby enlarging the scope of sports activities where chairlifts may serve as well as increase the usage of ski lifts to summer activities.

BRIEF DESCRIPTION OF THE DRAWING(S)

The invention will be described in conjunction with the following drawing figures, in which like elements are designated by like numerals.

FIGS. 1*a*-1*f* show one embodiment of the present invention, FIG. 1*a* being a side elevational view, FIG. 1*b* being a front elevational view, FIG. 1*c* being a rear elevational view, FIG. 1*d* being a perspective view, FIG. 1*e* being a detailed rear view and FIG. 1*f* being a top view.

FIGS. 2*a* -2*e* show another preferred embodiment of the present invention, FIG. 2*a* being an exploded, perspective view, FIG. 2*b* being a plan view of one of the machined plates of FIG. 2*a*, FIG. 2*c* being a side elevational view, FIG. 2*d* being a top view and FIG. 2*e* being a head-on view.

FIGS. 3*a* -3*d* show another preferred embodiment of the present invention, FIG. 3*a* being a perspective view, FIG. 3*b* a side view, FIG. 3*c* being a top view and FIG. 3*d* being a front view.

DETAILED DESCRIPTION OF THE PREFERRED EMBODIMENT(S)

Figure 10:
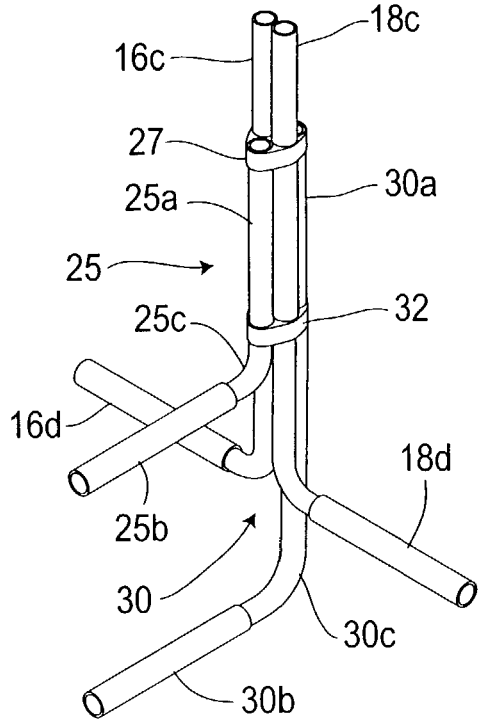
FIG. 10 is a perspective detailed view showing the snowboard support of FIG. 9.
Figure 9:
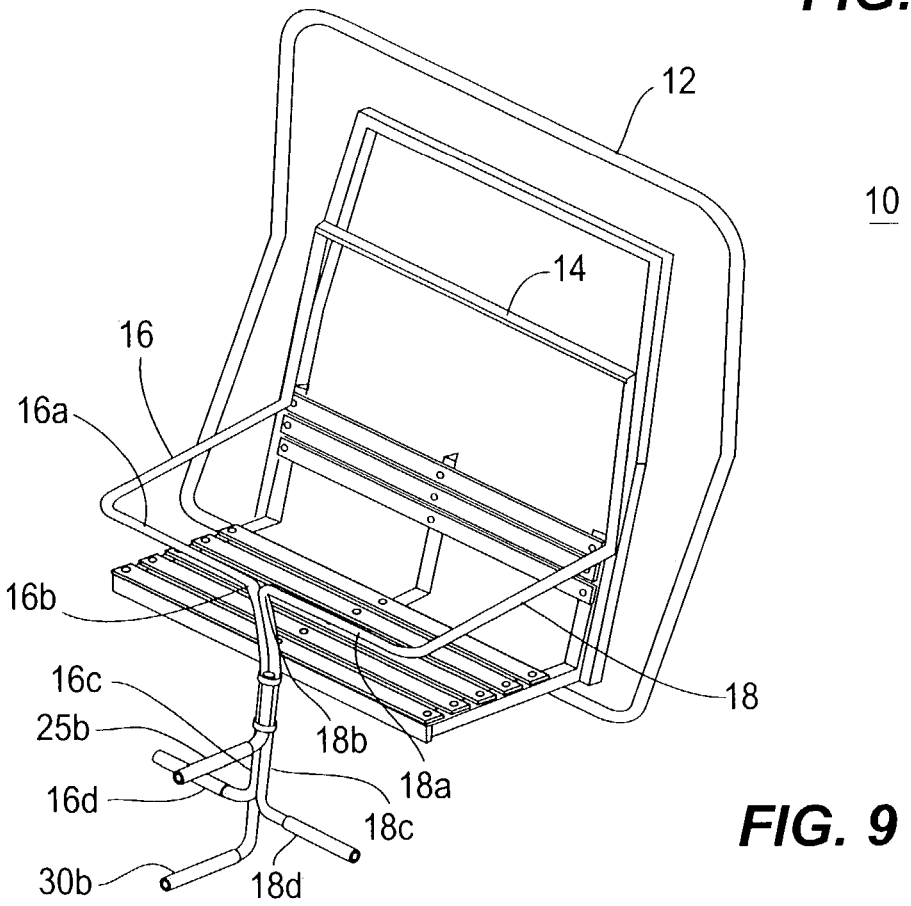
FIG. 9 is a perspective view of a chairlift incorporating the invention.

Making reference initially to FIGS. 9 and 10, there is shown therein a conventional chairlift 10 having an inverted, substantially U-shaped member 12 typically supported by an overhead cable and in turn supporting the chair, comprised of a back 14, sides 16 and 18, a seat 20 and two front bars 16*a*, 18*a* extending inwardly from sides 16 and 18 and bent downwardly at 16*b*, 18*b* and then diagonally downwardly and forwardly at 16*c* and 18*c* and terminating in outwardly extending ski rests 16*d* and 18*d*.

The chairlift 10 shown in FIG. 9 can accommodate two skiers wearing their skis wherein supports 16*d* and 18*d* each serve to support a pair of skis as the chairlift moves upwardly (or downwardly) to a take-off point or points.

The present invention, as shown in one embodiment in FIGS. 9 and 10, comprises a pair of L-shaped rods 25 and 30, arms 25*a* and 30*a* placed against downwardly depending portions 16*c*, 18*c* and being secured thereto by suitable securement members 27 and 32.

Members 25 and 30 have forwardly extending arm portions, 25*b* and 30*b*, which are integral with and extend outwardly from knees 25*c*, 30*c* so as to extend in a direction which preferably coincides with a forward movement of the ski chair.

Supports 16*d* and 18*d* each constitute conventional supports for one pair of skis. Arms 25*b* and 30*b* constitute upper and lower supports for snowboards. Either of these supports may be utilized by snowboarders regardless of whether they are seated in the right-hand or left-hand positions of the chairlift. Either passenger of the chairlift may use either support with equal ease. In addition, the chairlift, with the present invention retrofitted thereto, may accommodate a combination of two skiers, two snowboarders or one skier and snowboarder with the skier and snowboarder, respectively occupying either the left-hand and right-hand seats or the right-hand and left-hand seats.

The design of the present invention permits a rapid and simple retrofit while providing a rugged design capable of withstanding repeated and heavy use.

FIGS. 1*a*-1*f* show another embodiment 40 of the present invention employing novel bracket assemblies, to be more fully described herein below. In the embodiments shown in FIGS. 1*a*-1*f*, members 16*d*, 18*d* are each fitted with plastic sleeves, 16*e*, 18*e* being fitted onto portions 16*d*, 18*d* and serving to provide a protective cover preferably formed of a plastic material having a low coefficient of sliding friction so as to prevent the skis resting thereon from being damaged.

In a similar fashion, the arms 25*b* and 30*b* of members 25 and 30 are provided with sleeves 25*d*, 30*d* similar in design and function to the sleeves 16*e*, 18*e*.

The members 25 and 30 are mounted to the members 16*c* and 18*c* by a pair of bracket assemblies 35 which are similar in design and function and in view thereof, only one will be described herein for purposes of simplicity. Bracket assembly 35 is comprised of bracket halves 36 and 38. The interior surfaces, 36*a*, 38*a* receive and are designed to conform to the cylindrical shape of the members 25*a*, 30*a* and adjacent to these substantially semicircular-shaped cavities are quarter-circle-shaped recesses 36*b*, 36*c* and 38*b*, 38*c* which, when members 36 and 38 are joined in the manner shown in FIG. 1*f*, form a cylindrical-shaped recess.

Figure 1B:
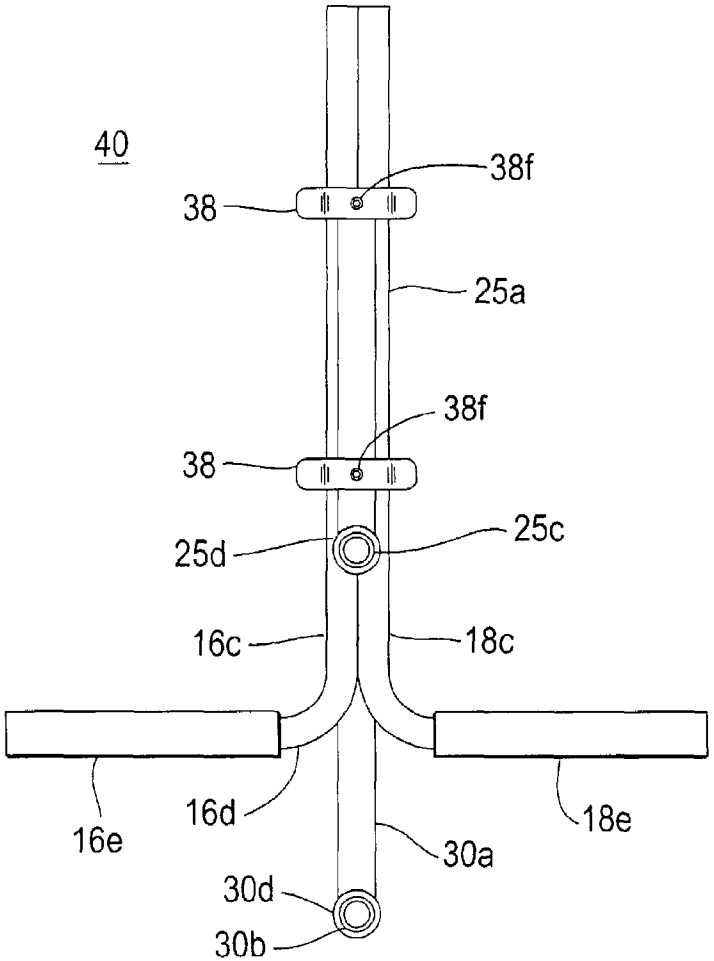
Figure 1A:
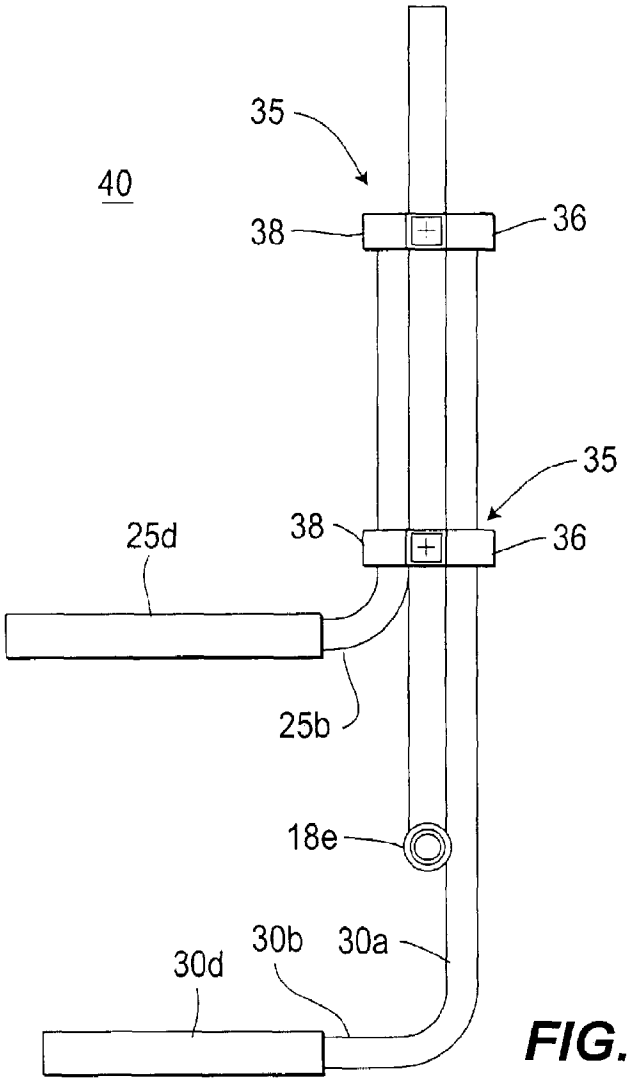
Figure 1C:
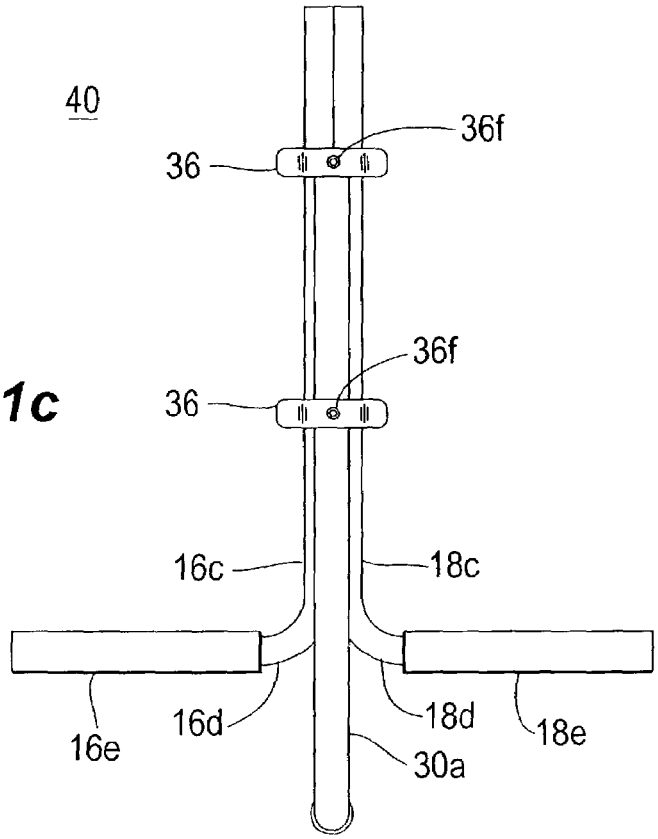
Figure 1D:
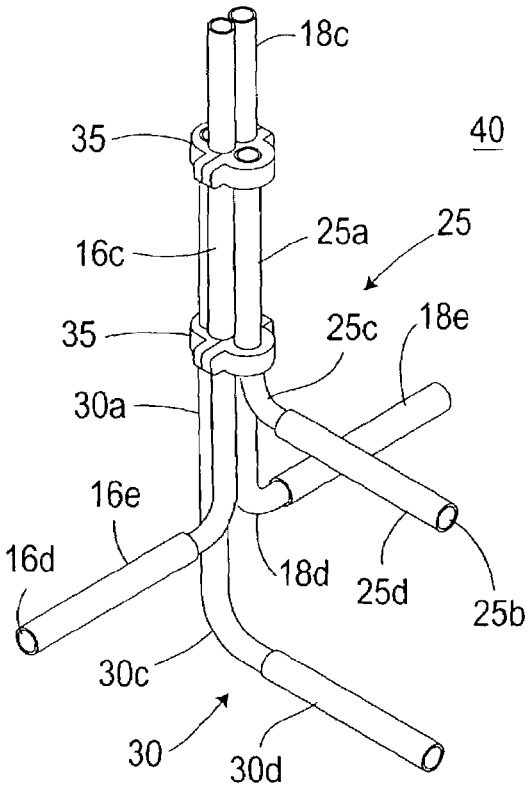
Figure 1E:
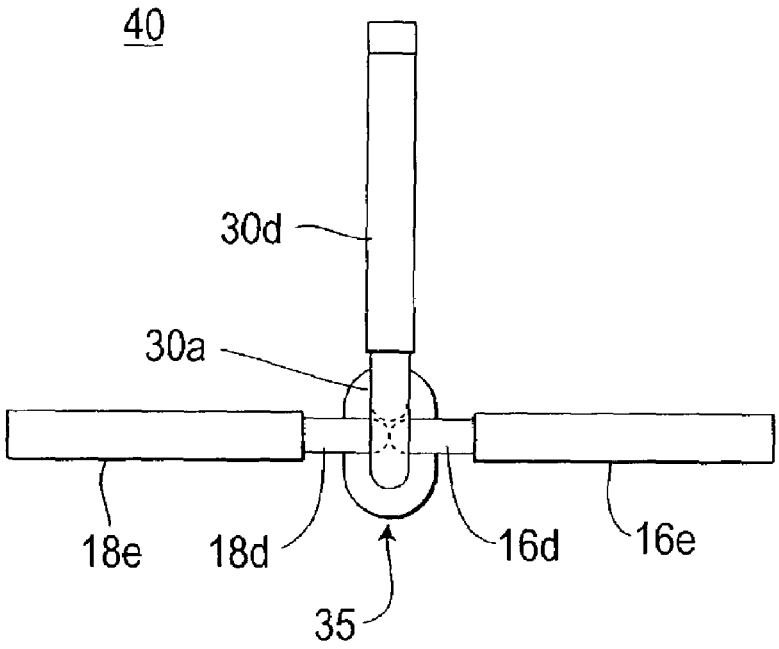
Figure 1F:
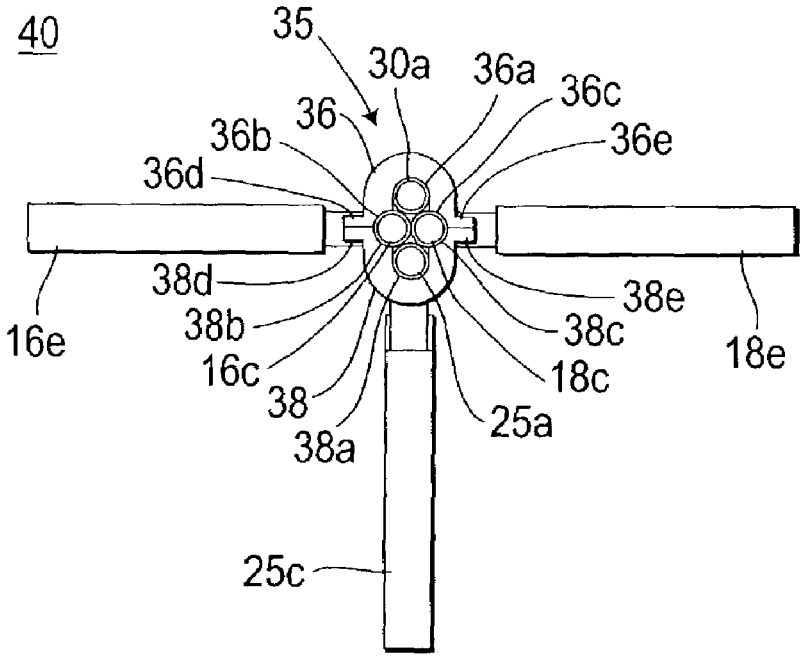

Bracket halves 36 and 38 are each provided with diametrically opposed fastening flanges 36*d*, 36*e* and 38*d*, 38*e*. When assembled, flanges 36*d* and 36*e* engage mating surfaces of flanges 38*d* and 38*e*. Suitable fastening means such as a cooperating threaded nut and bolt (not shown for purposes of simplicity) hold the bracket halves together. The recesses receiving members 30*a*, 25*a*, 18, 16*c* and 18*c* are preferably slightly smaller in size than the outer diameter of these tubular members in order to ensure intimate contact between the bracket halves 36 and 38 and the tubular members held therein. As shown best in FIGS. 1*d* and 1*c*, the bracket halves 36 and 38 respectively shown in FIGS. 1*c* and 1*d*, are provided with openings 36*f*, 38*f* receiving either threaded or self-tapping members which preferably are provided with tapered ends (not shown for purposes of simplicity) which intimately engage the tubular members 25*a*, 30*a* to prevent any movement of members 25 and 30 relative to brackets 35. In the preferred embodiment shown in FIGS. 1*a*-1*f*, sufficient compression of the bracket members is provided to lock the members 25 and 30 against movement relative to members 16*c*, 18*c*.

Although the embodiment shown in FIGS. 1*a*-1*f* accommodates tubular members 16*c*, 18*c*, 30*a*, and 25*a*, it should be understood that the interior recesses of brackets 36 and 38 may accommodate other configurations such as rectangular, square or other polygonal cross-sectional shapes. The interior recesses of the brackets may further be modified to accommodate mixed arrangements thereof. For example, the brackets may be modified to accommodate members 16*c* and 18*c* having a square cross-section while members 25*a* and 30*a* have cylindrical cross-section, or vice-versa.

Figure 2A:
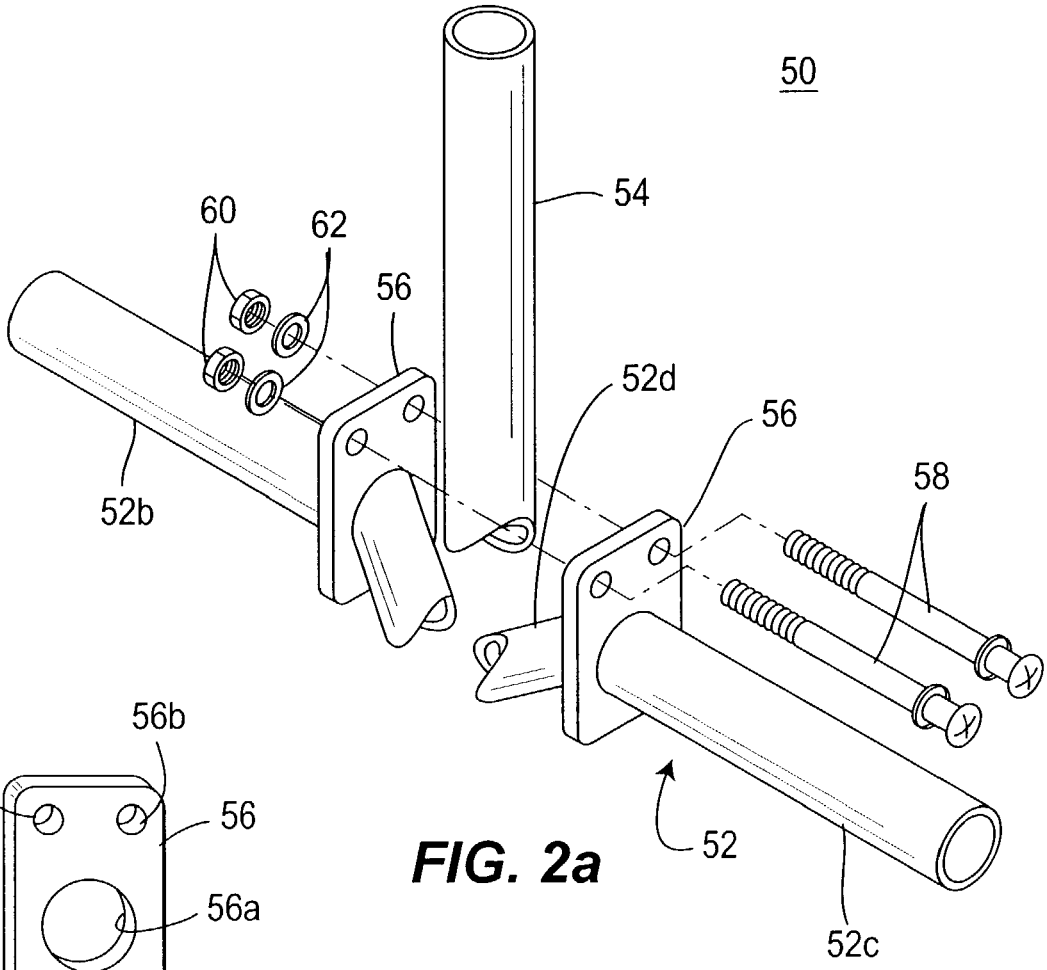
Figure 2B:
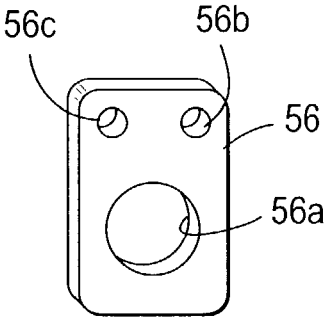
Figure 2C:
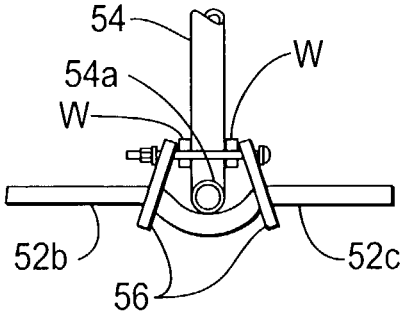
Figure 2D:
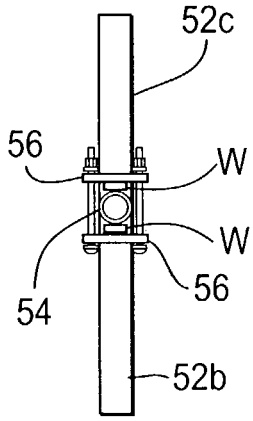
Figure 2E:
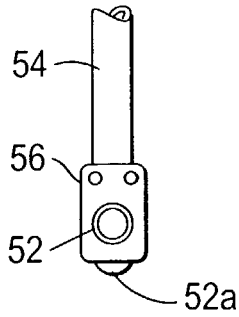

FIGS. 2*a*-2*e* show still another embodiment 50 comprised of a one-piece tubular member 52 having a curved intermediate portion 52*a* and integral arms 52*b*, 52*c*, integral with curved section 52*a* and extending in opposite directions therefrom, member 52*b* and 52*c* lying along a central longitudinal axis so that their upper surfaces lie in a common plane represented by dotted line P in FIG. 2*c*.

Bar 52 is mounted to an upright bar 54 by placing the concave surface 52*d* against the underside of the forwardly bent portion 54*a* of member 54, shown in FIGS. 2*a* and 2*c*. A pair of brackets 56 which are identical in design and function, have openings 56*a* for receiving opposing ends 52*b* and 52*c* of bar 52. A pair of elongated threaded bolts 58, are passed through a pair of openings 56*b*, 56*c* provided in each of the plates 56. Threaded nuts 60 and washers 62, when tightened on bolts 58, cause the upper ends of brackets 56 to be tilted toward one another as shown in FIG. 2*a* so as to form an angle with the vertical which clamps each of the brackets to the portions 52*b*, 52*c* of bar 52. A pair of wedge members W may be placed between plates 56 and vertical rod 54 to lock the bar 52 to vertical rod 54 and prevent any movement thereof.

The embodiment 60, of FIGS. 3*a*-3*d* comprises a tubular member 62 having a square cross-section, the underside of which is joined, preferably by welding, to a hollow tubular member 64 whose opposite ends 64*a*, 64*b* extend in opposite directions away from mounting rod 54. A pair of mounting brackets 66 are each comprised of a first clamp half 67 having a concave surface conforming to the cylindrical shape of member 54 and a second, cooperating clamp half 68 having an engaging surface conforming to the square shape of member 62. Suitable fastening members (not shown) join the clamp halves 67-68 to secure assembly 60 to rod 54.

Figure 3A:
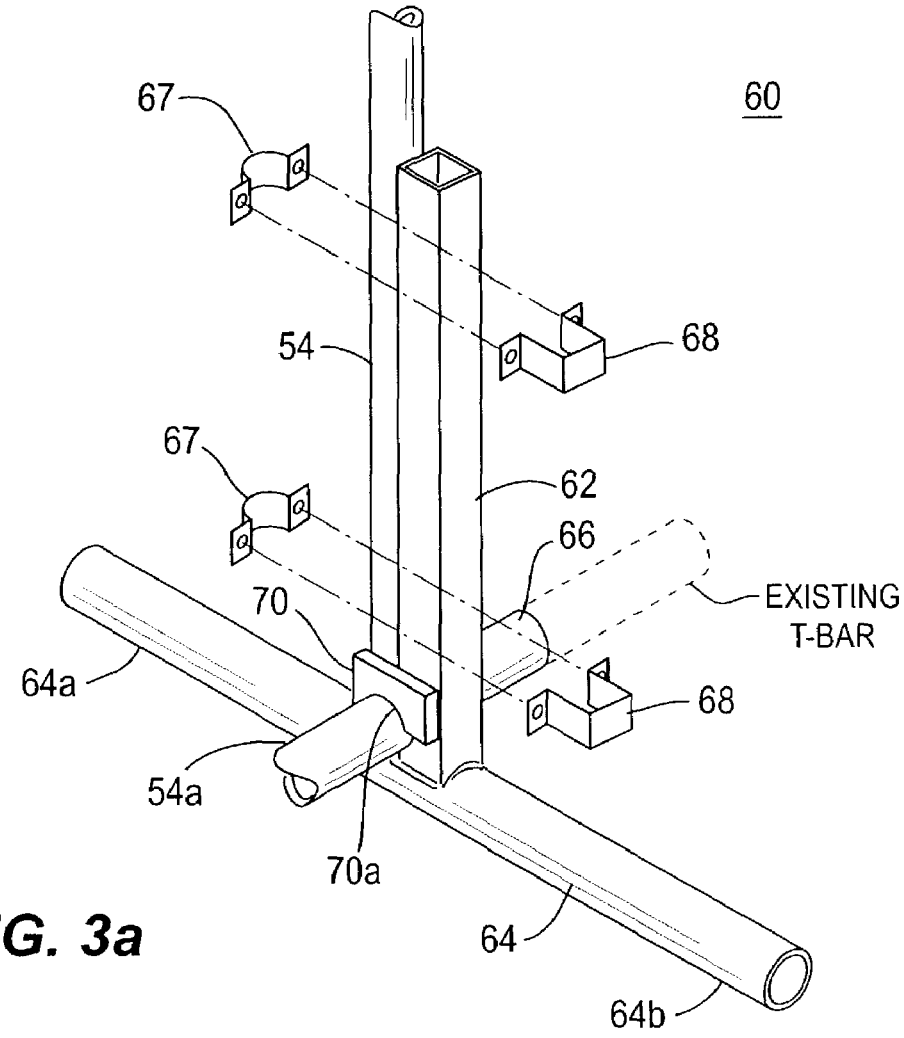
Figure 3B:
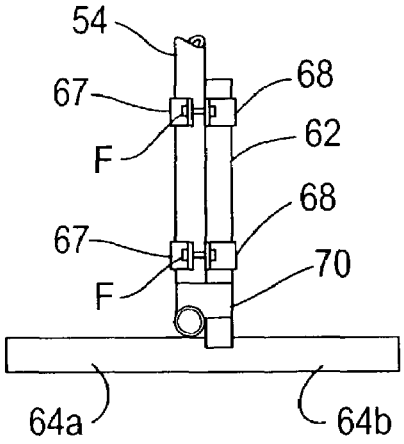
Figure 3C:
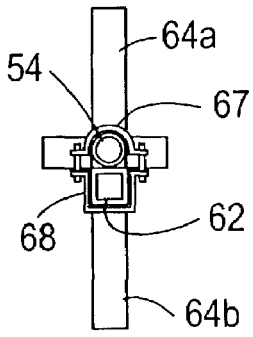
Figure 3D:
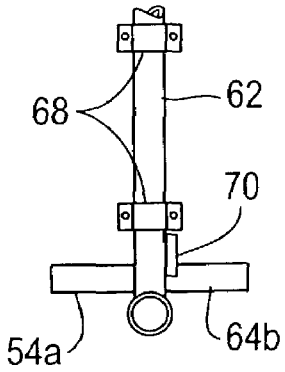

A plate 70, which is joined to member 62 preferably by welding, has a curved edge 70*a* partially embracing the outwardly extending rod 54*a* as shown best in FIGS. 3*a* and 3*b*.

Figure 4:
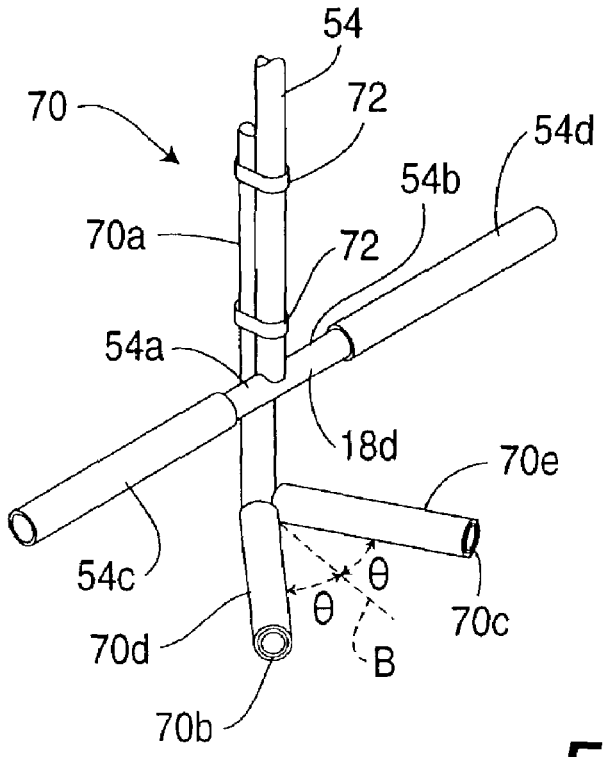
FIGS. 4-8 are perspective views showing other preferred embodiments of the present invention.

FIG. 4 shows another alternative embodiment 70 of the present invention in which the member 54 has two outwardly extending supports 54*a*, 54*b* covered with sleeves 54*c*, 54*d*. The retrofit bracket assembly embodiment 70 of the present invention comprises tubular member 70*a* joined to member 54 by brackets 72 which may be of any suitable type, for example, the type described hereinabove in connection with any of the previous embodiments, and having a pair of outward projections 70*b*, 70*c* covered with suitable sleeves 70*d*, 70*e*. Members 70*b* and 70*c* are angularly equidistant from the bisector line B by an angle θ. Each member 70*b*, 70*c* may support a snowboard.

Figure 5:
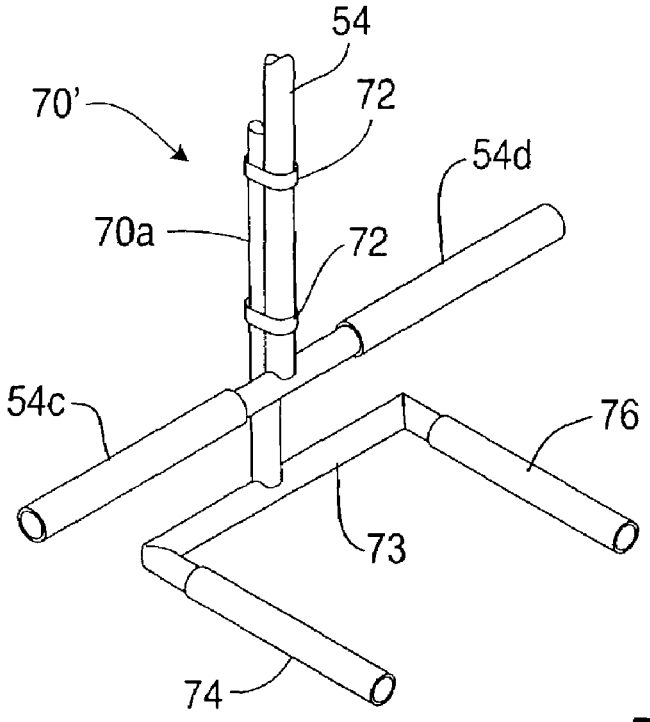

FIG. 5 shows another embodiment 70' in which member 70*a* is joined to a cross-piece 73 having extending support arms 74, 76 arranged at opposite ends of cross-piece 73 for respectively supporting a snowboard.

Figure 6:
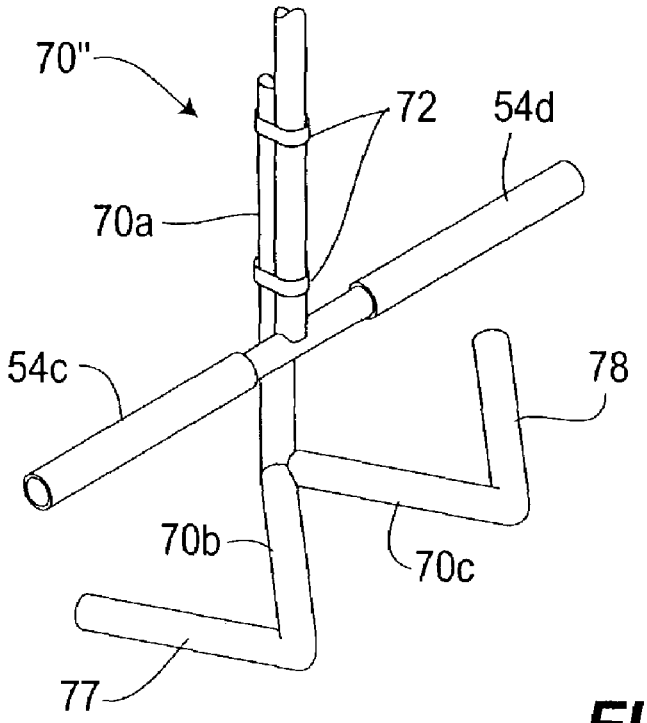

The embodiment 70" of FIG. 6 is substantially similar to the embodiment 70 of FIG. 4 with the arms 70*b*, 70*c* integrally joined at their free ends by diagonally aligned arms 77, 78.

Figure 7:
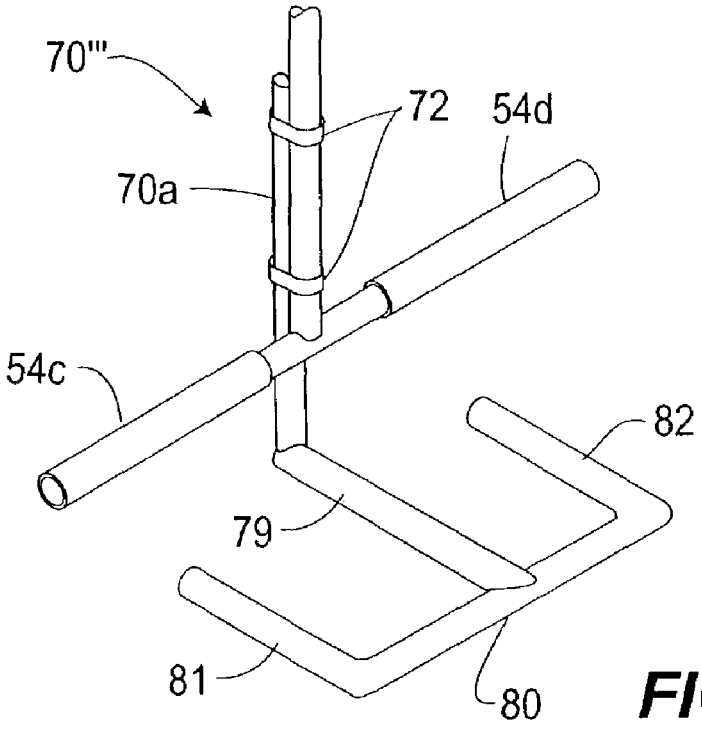

The embodiment 70''', shown in FIG. 7, is provided with a forwardly extended arm 79 joined to member 70*a* and having cross-piece 80 joined at its opposing end by support arms 81, 82 extending rearwardly toward member 70*a* to provide support for a snowboard.

Figure 8:
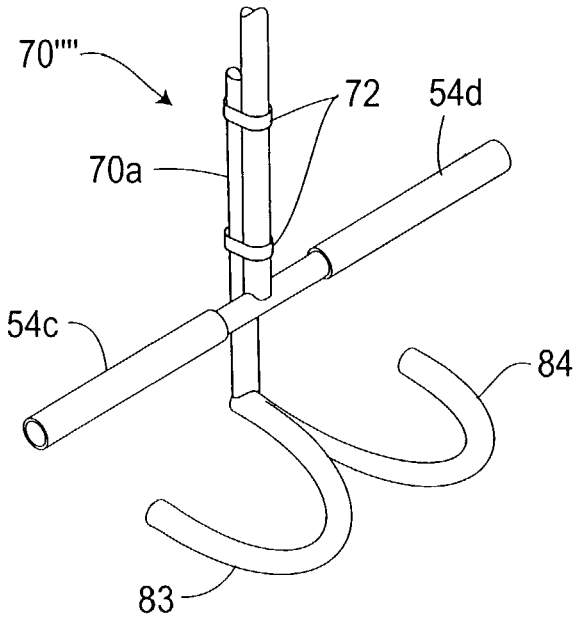

FIG. 8 shows an embodiment 70'''' in which support arm 70*a* is integrally joined at its lower ends with a pair of substantially U-shaped support arms 83, 84.

In the embodiments of FIGS. 4-8, the support arms extend substantially at right angles to arms 70*a*. However, these support arms may deviate from a "horizontal" alignment and form an angle of greater than or less than ninety degrees (90°) relative to arm 70*a*, the angle being formed being preferably within a range of the order of forty-five degrees (45°) to one-hundred and thirty-five degrees (135°), the function of these support arms being to support a snowboard so that the legs and snowboard of the snowboarder do not freely dangle beneath the chairlift.

Figure 11:
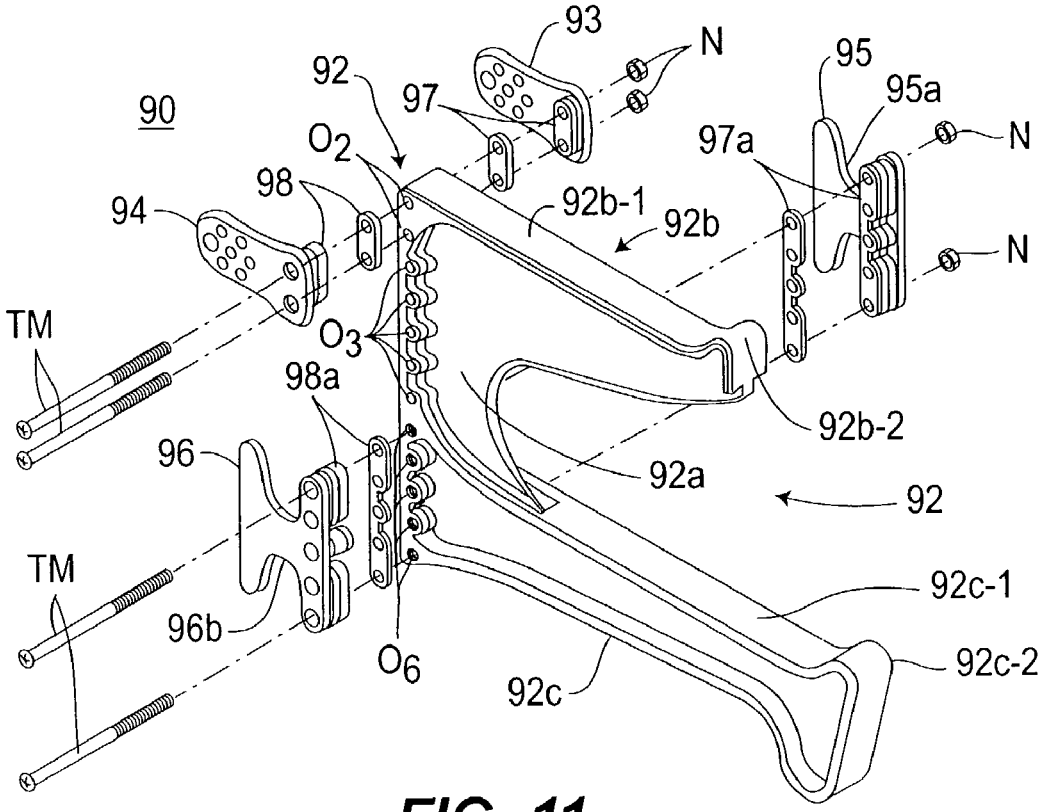
FIGS. 11-13 are perspective views of still another preferred embodiment of the present invention.
Figure 12:
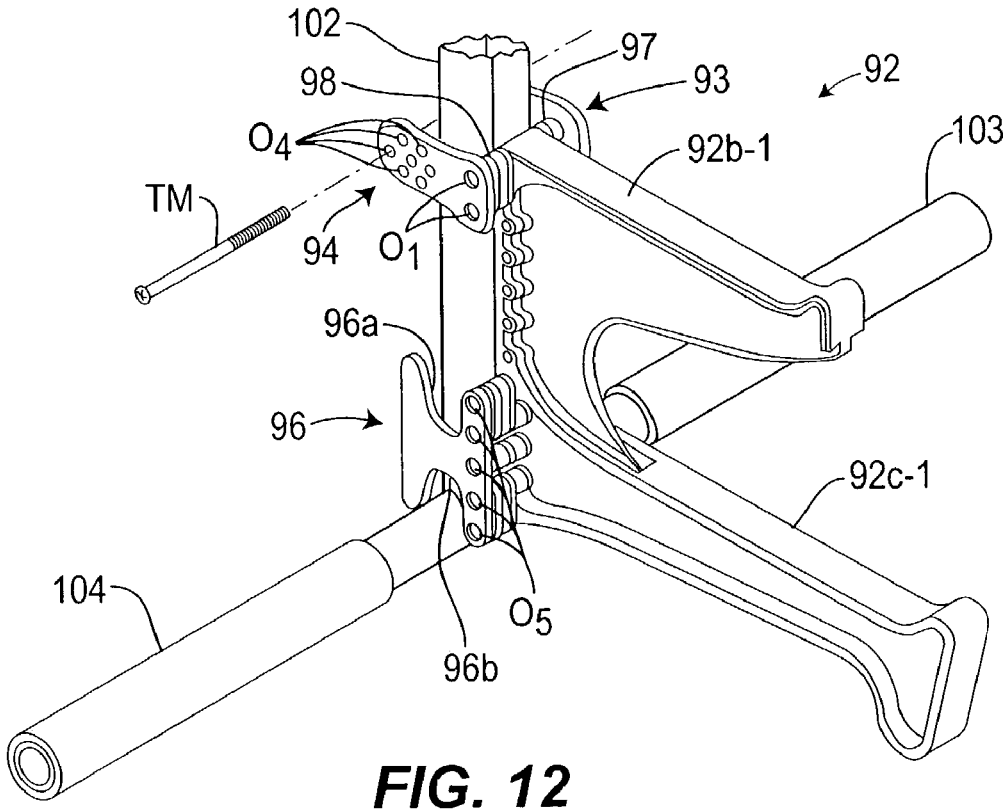
Figure 13:
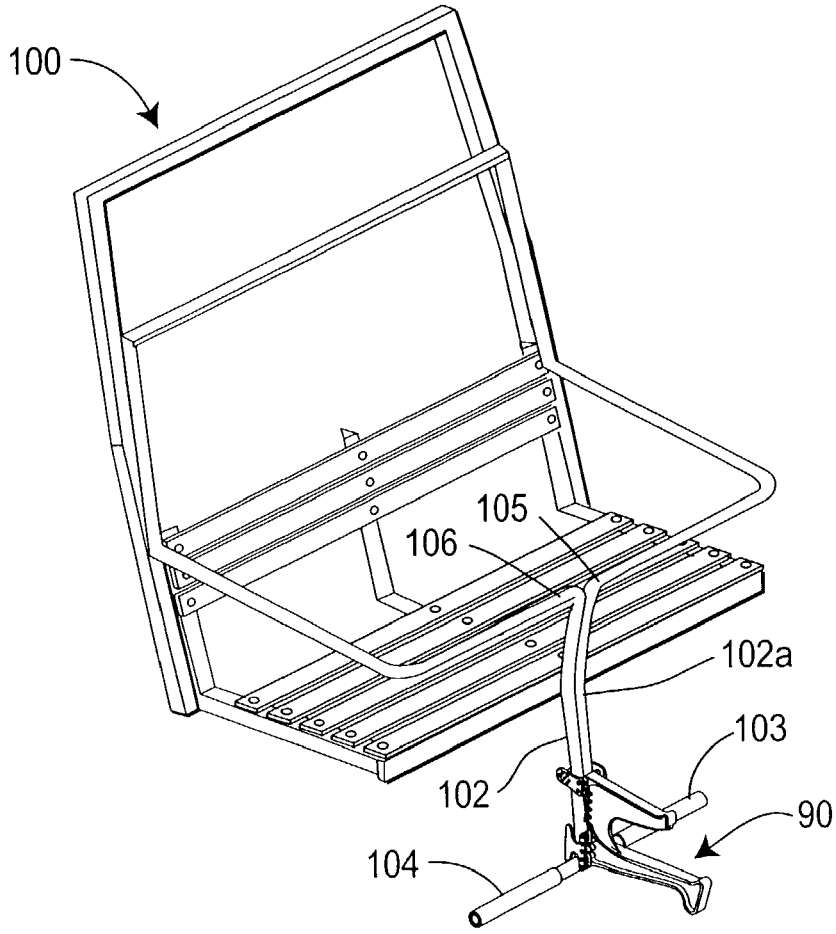

FIGS. 11-13 show still another embodiment 90 of the present invention comprised of a main body 92, a pair of upper-mounting brackets 93, 94 and a pair of lower-mounting brackets 95 and 96. Main body 92, which serves as the support for either one or two snowboards, has a rear portion 92*a* having integral support arms 92*b* and 92*c* extending forwardly therefrom. Each of the support arms has a substantially planar support surface 92*b*-1, 92*c*-1 terminating in an upwardly extending curved lip 92*b*-2, 92*c*-2.

The upper brackets 93 and 94 are substantially identical in design and function and are mirror images of one another and only one of these brackets will be described herein for purposes of simplicity. Bracket 94 is provided with a first pair of openings O1 each receiving one of the threaded members TM which extend through openings O1, openings O2 in member 92 and a pair of openings in bracket 93 similar to the openings O1 in bracket 94. Suitable fastening nuts N each threadedly engage one of the threaded members TM to secure brackets 93 and 94 to the main body 92. Washers (not shown) may be provided adjacent nuts N and/or threaded members TM.

The main body portion 92 is provided with additional openings O3 with the spacings between openings O3 being identical, thereby enabling the brackets 93 and 94 to be positioned to be aligned with the topmost holes O2, the bottommost holes of the group O3 or any position therebetween.

Bracket 94 is further provided with a group of openings O4. A threaded member TM extends through a selected one of the openings O4 and behind the vertical arm 102 extending downwardly from the chairlift 100 and having secured at its bottom end the supports 103 and 104 each adapted to accommodate a pair of skis of a skier. Those openings of the plurality of openings O4 through which threaded member TM extends is selected so as to embrace and substantially tightly fit the brackets 93, 94, threaded member TM and the rear surface of main member 92 about support 102.

In applications where the support 102 has a greater thickness, one or more spacers 97, 98 may be positioned between brackets 93 and 94 and the main body 92, as shown in FIGS. 11 and 12. If desired, a sleeve (not shown) may be placed around the exposed threaded portion of threaded member TM and a resilient member (not shown) such as a section of a rubber hose which has been cut along one longitudinal surface, may be placed about support 102 and be positioned so as to be embraced by the members 92, 93, 94 and the threaded member TM.

The lower brackets 95 and 96 have a substantially H-shaped configuration defined by upper and lower substantially U-shaped recesses. For example, member 96 has upper and lower U-shaped recesses 96*a* and 96*b*. Bracket 95 is substantially identical in design to bracket 96 and is a mirror image of bracket 95.

One longitudinal side of each bracket 95, 96 is provided with a plurality of mounting holes O5 which are arranged to be aligned with similar mounting holes O6 provided at the lower end of main body 92. Threaded members TM, in the embodiment shown in FIGS. 11 and 12, are extended preferably through at least the upper and lower openings of brackets 96 and 95 and through two of the group of openings O6 in member 92 to secure brackets 95 and 96 to member 92. Although two threaded members and cooperating nuts N are found to be sufficient to secure brackets 95 and 96 to member 92, additional fastening members and nuts may be employed, if desired. In addition, the brackets 95 and 96 may be moved upwardly or downwardly from the position shown in FIGS. 11 and 12 to accommodate other chairlift support arrangements.

As was described above with reference to brackets 93 and 94, in applications where the support 102 is of increased size, one or more spacers 97*a* and 98*a* may be positioned between the brackets 95 and 96 in the main body 92 in the manner shown in FIGS. 11 and 12.

When the assembly 90 is properly mounted, the lower U-shaped cutouts 95*b* and 96*b* provided in brackets 95 and 96 embrace the inner ends of crossbars 103 and 104.

Each support surface 92*b*-1 and 92*c*-1 is arranged to support a snowboard. The forward lips 92*b*-2 and 92*c*-2 serve to prevent a snowboard from sliding off of the support.

It can be seen that the retrofitting of the support assembly 90 is simple and quick and requires a minimum of fastening members. The weight of the support, coupled with the weight of one or more snowboards serves to retain the support in the position shown, for example in FIG. 12.

As with the prior embodiments, the assembly 90 enables use of a chairlift by both skiers and snowboarders either exclusively or in combination since the assembly 92 does not interfere with the use of the ski supports and vice versa.

Figure 14:
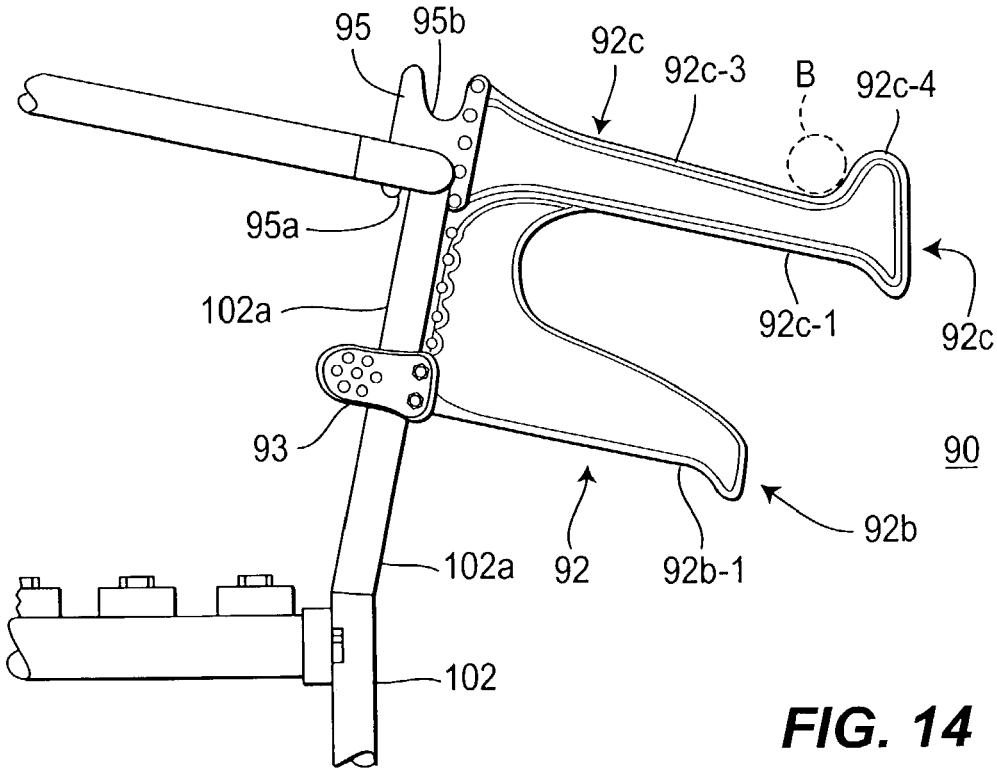
FIG. 14 is an elevational view of the embodiment of FIGS. 11-13 shown mounted upon a chairlift to accommodate a mountain bike.

The assembly 92 may also be utilized to accommodate a mountain bike. Making reference to FIG. 14, the brackets 93 and 94 are mounted to the main body 92 and the brackets 95 and 96 are mounted to the main body 92 in a manner identical to the manner of mounting and assembly shown in FIGS. 11 and 12. However, the assembly 90 is mounted "upside-down," so-to-speak in that the main body portion 92 is oriented so that arm 92*c* is positioned above arm 92*b*. The U-shaped cutouts 95*a* and 96*a* of brackets 95 and 96 are designed to embrace the portions 105 and 106 of the chairlift, as shown in FIG. 14, while the main body 92 and brackets 93 and 94 are positioned to embrace the upper portion 102*a* of support 102 as shown in FIGS. 13 and 14. At least one threaded member extends through appropriate openings in brackets 93 and 94 in a manner similar to that described above in order to secure the lower end of the assembly to the chairlift. The substantially U-shaped cutouts 95*a* and 96*a* embrace portions 105 and 106 of the chairlift, serving to hold the assembly in place and prevent it from sliding downwardly from the mounting position shown in FIG. 14. Surface 92*c*-3 serves as the support for a mountain bike. For example, the bar B shown as a dotted circle in FIG. 14 and which extends between the front fork and the seat post of a bicycle (not shown) may be positioned to rest upon surface 92*c*-3. Rounded lip 92*c*-4 serves to prevent the mountain bike from slipping off of the support 92*c*-3. It can thus be seen that the assembly 90 of FIGS. 11-14 is designed so as to serve as a snowboard support, as well as a mountain bike support without the need for additional mounting components and simply requiring a change in orientation of the support assembly depending upon the particular application.

It should be understood that the embodiments of the present invention may be utilized to provide a support arm for a single snowboarder as well as a pair (or more than a pair) of snowboarders. In addition, the supports may accommodate a mountain bike designed for mountain terrain.

What is claimed is:

1. An assembly used in combination with a chairlift for supporting one or more snowboards, said assembly comprising:

a main body portion;

first and second support arms integral with and extending away from said main body portion, each support arm having a support surface;

first and second mounting bracket assemblies being spaced apart by a given distance and being arranged to secure said assembly to a substantially vertical support member of the chairlift; and said support arms being arranged in spaced vertical fashion when mounted on said vertical support, each support surface being configured for supporting a snowboard.

2. The combination of claim 1 wherein a free end of each support arm has a projection extending away from said support surface to prevent a snowboard supported thereon from sliding off of said free end.

3. An assembly used in combination with a chairlift for supporting one or more snowboards, said assembly comprising:

a main body portion having mounting portion;

first and second support arms integral with and extending away from said mounting portion, each support arm having a support surface;

a mounting bracket assembly;

being arranged to join said mounting portion to a substantially vertical support member of the chairlift; and first and second support arms being arranged in spaced vertical fashion when mounted on said vertical support, each support surface being configured for supporting a snowboard.

4. The combination of claim 3 wherein said support arms are aligned transverse to a snow ski support provided on said vertical support member.

* * * * *